US005103266A

United States Patent [19]

Miyamoto et al.

[11] Patent Number: 5,103,266

[45] Date of Patent: Apr. 7, 1992

[54] ELECTROPHOTOGRAPHIC APPARATUS AND METHOD OF CLEANING THE SAME

[75] Inventors: Tsuyoshi Miyamoto, Osaka; Yasutaka Maeda, Ikoma; Taisuke Kamimura, Kita-Katsuragi; Katsuhiro Nagayama; Hideyuki Nishimura, both of Yamoto-Koriyama; Natsuko Tanaka, Fukuoka, all of Japan

[73] Assignee: Sharp Kabushiki Kaisha, Osaka, Japan

[21] Appl. No.: 667,839

[22] Filed: Mar. 12, 1991

[30] Foreign Application Priority Data

Mar. 13, 1990 [JP] Japan ..... 2-62210

[51] Int. Cl.[5] ..... G03G 21/00

[52] U.S. Cl. ..... 355/299; 355/296; 118/652; 430/125

[58] Field of Search ..... 355/296, 299, 204, 208, 355/219, 225, 326, 327; 118/652; 430/125; 15/1.51

[56] References Cited

U.S. PATENT DOCUMENTS 4,788,572 11/1988 Slayton et al. ..... 355/317

*Primary Examiner*—A. T. Grimley
*Assistant Examiner*—Matthew S. Smith
*Attorney, Agent, or Firm*—David G. Conlin; Donald Brown

[57] ABSTRACT

A method of cleaning a photosensitive member in an electrophotographic apparatus in which an electrophotographic operation is performed by charging the photosensitive member with a predetermined voltage, exposing the charged photosensitive member so as to form a latent image thereon and developing the latent image by use of toner, includes the steps of charging the photosensitive member with a half tone level voltage which is smaller than the predetermined voltage, and developing the charged photosensitive member by use of toner without exposing the charged photosensitive member, so as to form a uniform half tone toner image thereon. The cleaning method also includes the step of scraping off the toner of the uniform half tone toner image from the photosensitive member by a blade abutting thereto.

11 Claims, 4 Drawing Sheets

ELECTROPHOTOGRAPHIC APPARATUS AND METHOD OF CLEANING THE SAME

BACKGROUND OF THE INVENTION

1. Field of the Invention

The present invention relates to an electrophotographic apparatus such as a copying apparatus, and a method of cleaning a photosensitive member in the electrophotographic apparatus.

2. Description of the Related Art

An electrophotographic apparatus includes a photosensitive member, such as a photosensitive drum or a photosensitive belt member, on which a latent image is formed by an exposing operation and then a toner image is formed by a developing operation. The tonner image is transferred to a recording sheet directly or via a transferring member from the photosensitive member.

Accordingly, it is desirable to transfer all the toner of the toner image from the photosensitive member to the recording sheet. However, a certain amount of the toner of the toner image is remained to be attached on the photosensitive member after this transferring operation.

Thus, the electrophotographic apparatus is equipped with a cleaning device which removes such undesirable residual toner from the photosensitive member. The cleaning device also removes corona products, paper or sheet powders, and an ozone degraded layer formed at the extreme surface of the photosensitive member. The corona products are formed during the charging process of the photosensitive member, while the ozone degraded layer is formed during the transferring process.

In case that the photosensitive member is made from the organic photosensitive compound (OPC), such a cleaning operation becomes very important, since the above mentioned residual toner etc. affects and degrades the image quality to a great extent in this case.

As one type of such cleaning devices, there is a blade cleaning type, which cleans the photosensitive member by pressing a blade onto the photosensitive member after the electrophotographic operation, so as to scrape off the residual toner etc. from the photosensitive member.

However, the cleaning ability of above mentioned cleaning method is not always sufficient. Especially, in case of a high speed copying apparatus and a full color copying apparatus, the above mentioned cleaning method is not enough. Namely, in case of the high speed copying apparatus, the corona products and the sheet or paper powders are generated in a great amount. In case of the full color copying apparatus, the toner is relatively difficult to remove from the photosensitive member in which filming of the toner easily occures due to its low melting point. Thus, in these apparatuses, since the above mentioned cleaning method is not enough, the quality of the outputted image is degraded by the residual toner etc. while the photosensitive member is easily damaged by these undesirable existences.

The above mentioned problem is enhanced in case that a large number of copying operations are continuously performed, which is quite normal case in the practical use. Thus, this mentioned problem is practically a quite serious one.

As a countermeasure for this problem, the pressure of the cleaning blade against the photosensitive member may be increased so as to increase the cleaning ability.

But, this turns out to cause another problem that the photosensitive member is damaged especially in case of the aforementioned OPC type photosensitive member, though this damage is not so serious in case of the amorphous selenium or amorphous silicon type photosensitive member which surfaces are relatively hard.

Consequently, inspite of a general demand to improve the image quality of the electrophotographic apparatus, image defects such as fogging and voiding in the outputted image, are caused by these residual toner etc. because a sufficient cleaning method is not realized.

SUMMARY OF THE INVENTION

It is therefore a first object of the present invention to provide a method of cleaning the electrophotographic apparatus, which can clean the photosensitive member effectively and sufficiently.

It is a second object of the present invention to provide an electrophotographic apparatus in which the cleaning method of the present invention can be performed.

According to the present invention, the first object can be achieved by a method of cleaning a photosensitive member in an electrophotographic apparatus in which an electrophotographic operation is performed by charging the photosensitive member with a predetermined voltage, exposing the charged photosensitive member so as to form a latent image thereon and developping the latent image by use of toner. The cleaning method includes the steps of charging the photosensitive member with a half tone level voltage which is smaller than the predetermined voltage, and developping the charged photosensitive member by use of toner without exposing the charged photosensitive member, so as to form a uniform half tone toner image thereon. The cleaning method also includes the step of scraping off the toner of the uniform half tone toner image from the photosensitive member by a blade device abutting thereto.

According to the cleaning method of the present invention, the photosensitive member is charged with a half tone level voltage which is smaller than the predetermined voltage for the electrophotographic operation. Then, the charged photosensitive member is developped by use of toner. At this time, the charged photosensitive member is not exposed. Thus, a uniform half tone image is formed on the photosensitive member. Accordingly, since the toner of the half tone toner image is attached on the photosensitive member with a relatively small strength, the toner is effectively and sufficiently removed from the photosensitive member by scraping off by a blade device abutting thereto. At this time, the corona products, the paper or sheet powders, and the ozone degraded layer can be also removed together with the residual toner from the photosensitive member. And that, since the half tone toner image is uniformly formed, this cleaning operation can be uniformly performed on the photosensitive member. Further, in the cleaning method of the present invention, since the toner serves as an abrasive powder, the cleaning ability can be easily enhanced just by utilizing such a toner as having a high abrasive ability or just by adding a small amount of abrasive material into the toner for cleaning.

Consequently, the image defects such as fogging and voiding in the outputted image, caused by these residual toner etc. can be eliminated by the present invention to improve the image quality of the electrophotographic apparatus.

According to the present invention, the second object can be achieved by an electrophotographic apparatus including a photosensitive member and a device for charging the photosensitive member selectively with a predetermined voltage for an electrophotographic operation and a half tone level voltage which is smaller than the predetermined voltage. The electrophotographic apparatus also includes a device for exposing the charged photosensitive member, so as to form a latent image thereon, and a device for developping the latent image by use of toner, so as to form a toner image thereon. The electrophotographic apparatus also includes a device for counting the number of times of the electrophotographic operation, and a device for cleaning the photosensitive member, including a blade abutting to the photosensitive member for scraping off the toner therefrom. The electrophotographic apparatus further includes a control device for directing the charging device to charge with the half tone level voltage once every prescribed times of the electrophotographic operations based on a count of the counting device, and directing the developping device to develop while stopping the exposing device to expose, so as to form a uniform half tone toner image on the photosensitive member. Accordingly, the above mentioned cleaning method of the present invention can be performed once every prescribed times of the electrophotographic operations based on the count of the counting device under the control of the control device, in the electrophotographic apparatus of the present invention.

Further objects and advantages of the present invention will be apparent from the following description of the preferred embodiment of the invention as illustrated in the accompanying drawings.

DETAILED DESCRIPTION OF THE PREFERRED EMBODIMENT

A preferred embodiment of the present invention will be described below with reference to the accompanying drawings. In this embodiment, a cleaning method is performed in a full color copying apparatus of double transferring type with toner having a low melting point.

Figure 1:
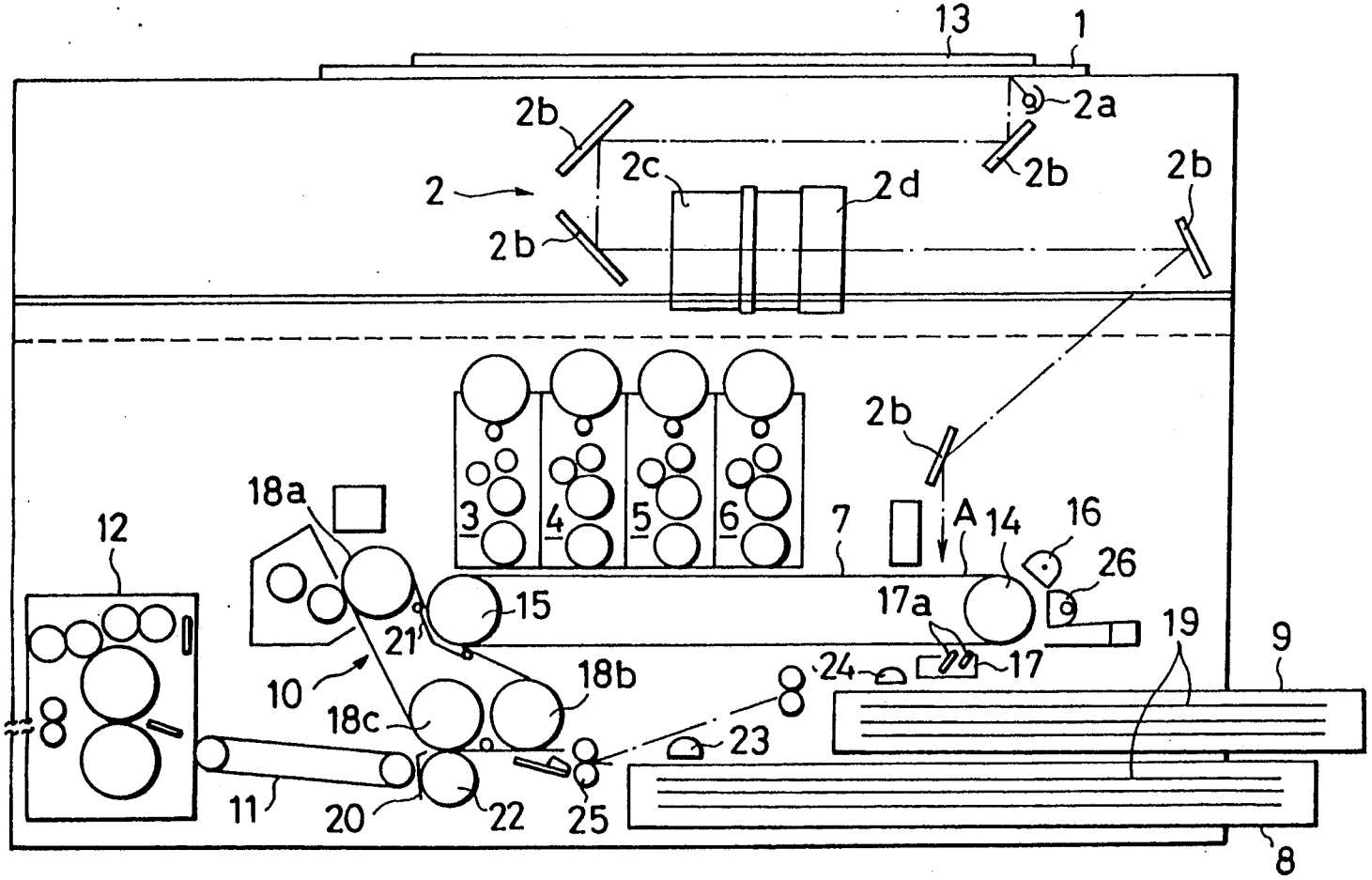
FIG. 1 is a schematic constructional view showing a full color copying apparatus as one embodiment of the present invention.

FIG. 1 shows a copying apparatus as an embodiment according to the present invention.

In FIG. 1, the copying apparatus is provided with a transparent original table 1 at an upper side of a main body thereof. Below the transparent original table 1, there is an exposing optical system 2, which includes a light source 2*a* for illuminating an original 13 placed on the transparent original table 1, and reflection mirrors 2*b* for guiding the reflected light from the original 13 to a photosensitive member 7. The optical path of the reflected light guided by the reflection mirrors 2*b* is indicated by a chain line. There is also provided in the optical path of the reflected light, a focusing lens 2*c* and a color separation filter 2*d* having three primary color filters of red, green and blue.

The reflected light through the exposing optical system 2 is introduced to the photosensitive member 7 at a position A. The photosensitive member 7 is made from OPC in a belt form, to which the latent image corresponding to the image of the original 13 is formed by the exposure of the reflected light.

Sheet supplying cassettes 8 and 9 accommodating a plurality of recording sheets 19 are disposed at lower right side of the photosensitive member 7. Above the sheet supplying cassettes 8 and 9, there are provided sheet supplying rollers 23 and 24. These sheet supplying rollers 23 and 24 are adapted to transport the recording sheets 19 one by one from the sheet supplying cassettes 8 and 9 respectively to an intermediate transferring member 10.

Timing rollers 25 are disposed between the intermediate transferring member 10 and the sheet supplying rollers 23 and 24. The timing rollers 25 are adapted to rotate in synchronization with the intermediate transferring member 10. The intermediate transferring member 10 is driven by a first, second and third rollers 18*a*, 18*b* and 18*c*, and is pressed onto a driving roller 15 which drives the photosensitive member 7.

Opposing to the roller 15 through the intermediate transferring member 10, there is equipped a transferring charger 21. Opposing to the third roller 18*c* through the intermediate transferring member 10, there is equipped a transferring roller 22. At the downstream side of the transferring roller 22, there are equipped a peeling plate 20, a transporting belt 11 and a fixer device 12 in this order.

The photosensitive member 7, which is exposed by the reflected light from the exposing optical system 2 and on which the latent image is formed, is drived by a driven roller 14 and the roller 15. At the external of the photosensitive member 7 near the roller 14, there are provided an electric charger 16 for charging the photosensitive member 7 and a discharging lamp 26 for discharging the photosensitive member 7.

There is also provided a cleaning device 17 of blade cleaning type near the discharging lamp 26 for removing the residual toner, the sheet or paper powders, the corona products and the ozone degraded layer on the photosensitive member 7. The cleaning device 17 includes cleaning blades 17*a*, which are made of a urethane, for example, and pressed against the photosensitive member 7 so as to scrape off the residual toner etc. from the photosensitive member 7.

Above the middle portion of the photosensitive member 7, a black developping device 6 for the black and white developping operation, and a yellow developping device 4, a magenta developping device 5, and a cyanogen developping device 6 for the color developping operation, are equipped. Each of the developping devices 4, 5 and 6 has a container each contains yellow, magenta and cyanogen toners respectively, where yellow serves the complementary color of blue, magenta serves the complementary color of green, and cyanogen serves a complementary color of red. Each of the developping devices 4, 5 and 6 has a set of magnetic rollers for supplying the toner from the container onto the photosensitive member 7, respectively.

The black developping device 3 has a container which contains black toner including abrasive material such as a magnetite of 0.2 to 1.0 wt %, so as to improve the abrasive effect with respect to the photosensitive member 7. As the abrasive material, titanium oxide may be utilized other than the magnetite. Since such abrasive material has a certain color, the abrasive material is preferably included in the black toner of the black developping device 3. The black developping device 3 has a set of magnetic rollers for supplying the toner with the abrasive material onto the photosensitive member 7.

Figure 2:
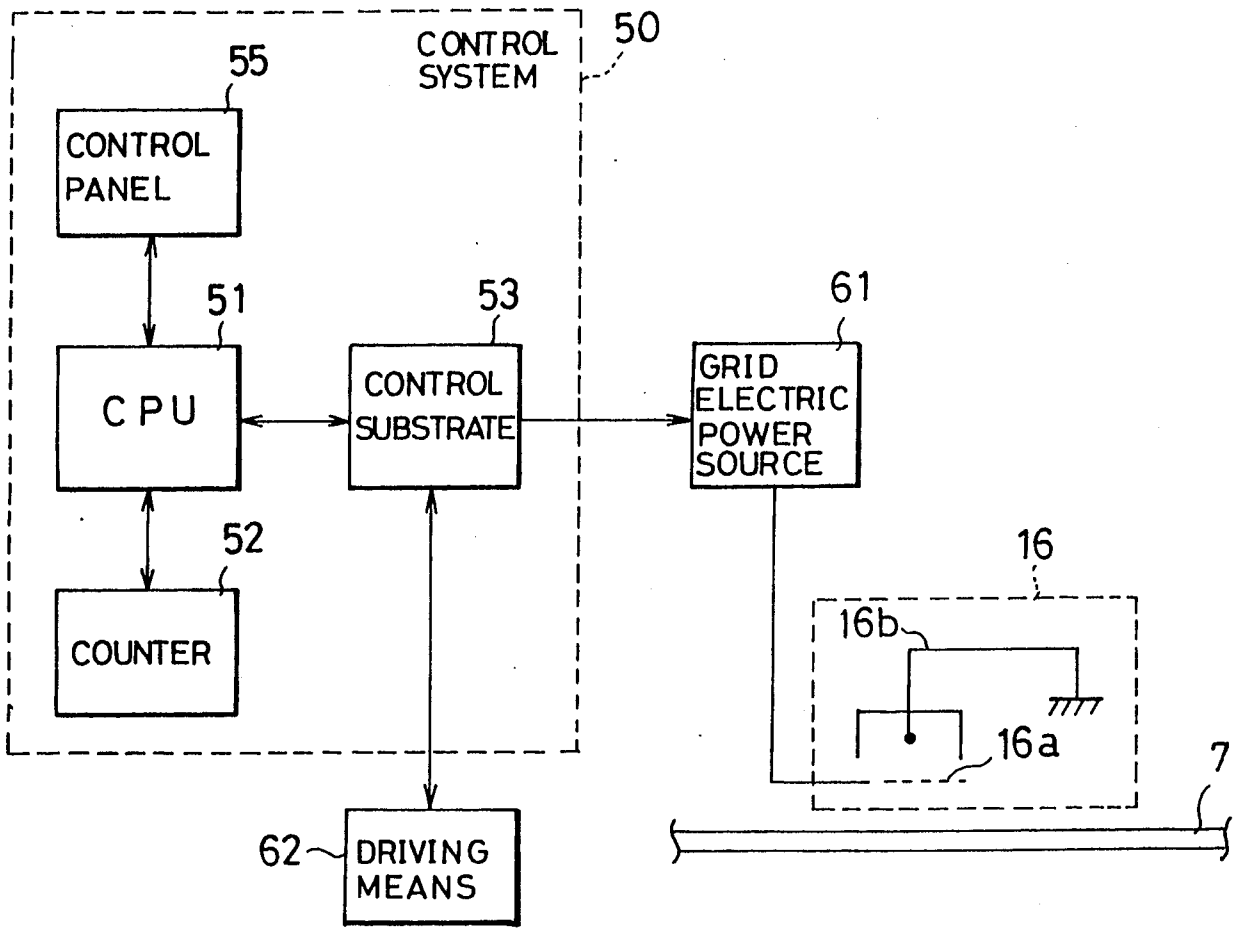
FIG. 2 is a block diagram showing a control system of the copying apparatus of FIG. 1.

FIG. 2 shows the control system provided in the copying apparatus, which is not shown in FIG. 1.

In FIG. 2, a control system 50 includes a CPU (Central Processor Unit) 51, a counter 52, a control substrate 53, and a control panel 55.

The control panel 55 is disposed on the upper surface of the main body of the copying apparatus, and includes a copy switch for starting the copying operation, a ten key switch for setting the number of the copies and the magnification of copy etc., a selection switch for selecting either the color copy or the black and white copy, and so on, so as to allow various kinds of copy operations.

The CPU 51 such as a microcomputer enables various copy operations by use of the control substrate 53 according to the command from the control panel 55. The control substrate 53 is connected with a grid electric power source 61 and a driving means 62.

The grid electric power source 61 is connected with a screen grid 16*a* of the electric charger 16 so as to change the charging voltage level of the electric charger 16 for dealing with both of the copy mode operation and the special cleaning mode operation as described later. It is shown that the electric charger 16 includes the screen grid 16*a* and a main charger 16*b*. The charging level of the photosensitive member 7 depends on the voltage applied to the screen grid 16*a* with the constant output power of the main charger 16*b*. This voltage is controlled by the CPU 51 via the control substrate 53.

The driving means 62 is adapted to drive a plurality of rollers i.e. the rollers 15, 18, 22, 23, 24, 25 and the magnetic rollers of the developping devices 3 to 6, in a prescribed manner controlled by the CPU 51 as described later.

The counter 52 is adapted to count each copy mode operation. Namely, the count of the counter 52 is increased one by one according to the number of the copied sheet 19. This counter 52 enables the special cleaning mode operation which is periodically executed per certain times of the copy mode operations as described later.

The explanation for the cleaning method of the present embodiment together with the copy mode operation will be made hereinbelow, as for the case that a multiple copy operation of full color type is performed by a plurality of times in the above mentioned copying apparatus, with referring to FIG. 3.

Figure 3:
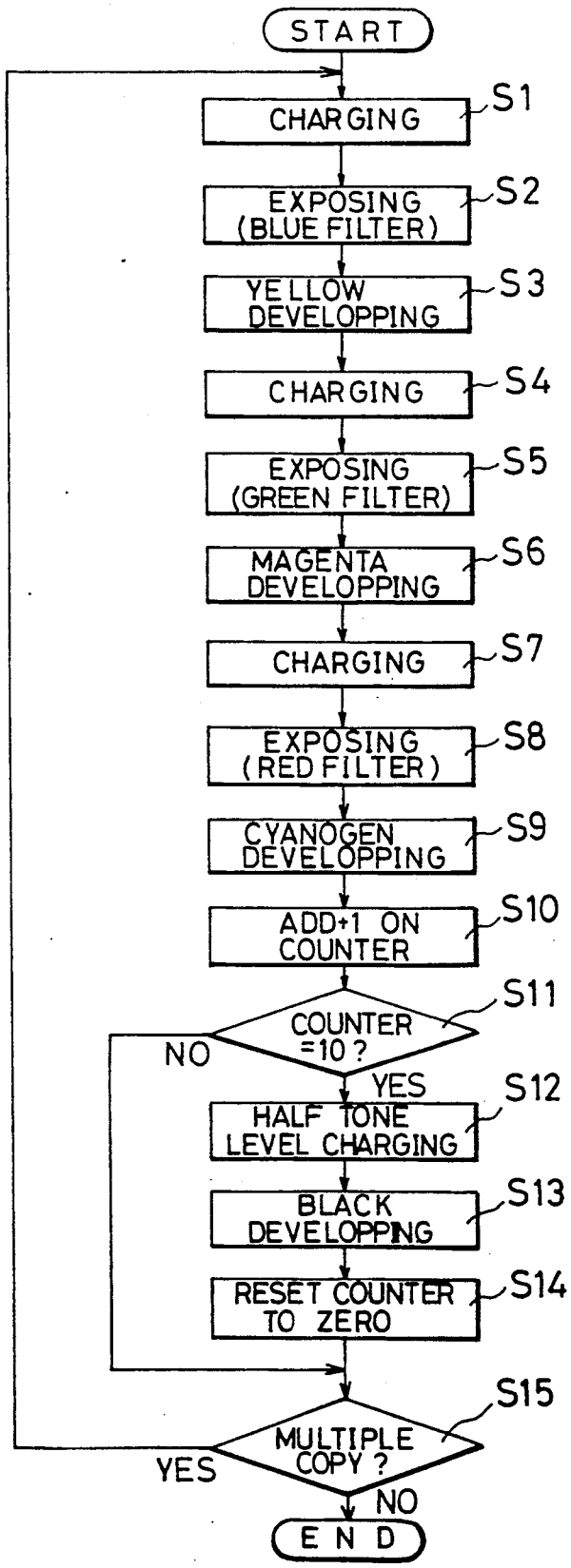
FIG. 3 is a flow chart showing an operation of the copying apparatus of FIG. 1.

FIG. 3 shows a flow chart of such a kind of copy operation under the control of the CPU 51. This operation includes the copy mode operations of forming yellow, magenta and cyanogen images, and the special cleaning mode operation.

In FIG. 3, one consecutive copy mode operations are started by pressing the copy switch on the control panel 55. At this time, the original 13 to be copied is placed on the transparent original table 1. Then, the photosensitive member 7 is uniformly charged by the electric charger 16 (step S1).

The exposing operation is performed by the exposing optical system 2 by use of the blue filter (step S2). Namely, the lamp 2*a* illuminates the original 13 so as to scan the original 13 while the photosensitive member 7 is exposed at the position A by the reflected light from the original through the blue filter, as the photosensitive member 7 is driven to move by the rollers 14 and 15. Thus, the latent image for yellow, which is the complementary color of blue, is obtained on the photosensitive member 7.

Then, the developping operation is performed by use of the yellow developping device 4, so as to form the yellow toner image on the photosensitive member 7 (step S3). Then, this toner image is transferred to the intermediate transferring member 10 by the transferring charger 21. When the above described yellow cycle (step S1 to S3) is completed, the photosensitive member 7 is cleaned by the cleaning device 17 and discharged by the discharging lamp 26, as the photosensitive member 7 is driven to move by the rollers 14 and 15.

Then, the magenta cycle is performed in a same manner. Namely, the photosensitive member 7 is charged again by the electric charger 16 (step S4), the exposing operation is performed by use of the green filter (step S5), and the developping operation is performed by use of the magenta developping device 5 (step S6), so as to form the magenta toner image on the intermediate transferring member 10 at a same position as the yellow toner image. When the magenta cycle (step S4 to S6) is completed, the photosensitive member 7 is cleaned by the cleaning device 17 and discharged by the discharging lamp 26.

Then, the cyanogen cycle is performed in a same manner. Namely, the photosensitive member 7 is charged again by the electric charger 16 (step S7), the exposing operation is performed by use of the red filter (step S8), and the developping operation is performed by use of the cyanogen developping device 6 (step S9), so as to form the cyanogen toner image on the intermediate transferring member 10 at a same position as the yellow and magenta toner images. Accordingly, one color toner image made of the overlapped yellow, magenta and cyanogen toners, is obtained on the intermediate transferring member 10.

On the other hand, the recording sheet 19 accommodated in the sheet supplying cassettes 8 and 9 is supplied one by one by the sheet supplying rollers 23 and 24 to the timing rollers 25. Then, the timing rollers 25 transport the recording sheet 19 to the space between the intermediate transferring member 10 and the transferring roller 22 in synchronization with the intermediate transferring member 10. At the transferring roller 22, the color toner image is transferred onto the recording sheet 19. Then, the recording sheet 19 is peeled off from the intermediate transferring member 10 by the peeling plate 20 and is introduced to the fixer device 12, where the fixing operation for the color toner image is performed. Finally, the recording sheet 19 on which the color image corresponding to the original 13, is outputted from the copying apparatus, and one copy mode operation is completed.

When the cyanogen cycle (steps S7 to S9) is completed, the CPU 51 adds +1 to the counter 52. Then at the step S11, if the count of the counter 52 is less than 10 (NO), the photosensitive member 7 is cleaned by the cleaning device 17 and discharged by the discharging lamp 26 just in the same manner as in the normal cleaning operation after the yellow and magenta developping operation as aforementioned.

If the count of the counter 52 is 10 at the step S11 (YES), the special cleaning mode operation S12 to S14 is executed. Namely, the transferring charger 21 is stopped to operate. The developping devices 4, 5 and 6 are set in their rest conditions while the black developping device 3 is set in its developping condition. On the other hand, the electric charger 16 charges the photosensitive member 7 with a half tone level voltage, which is lower than the charging voltage in the normal copy mode operations (step S12). This voltage change of the electric charger 16 can be executed by use of the grid electric power source 61 under the control of the CPU 51 via the control substrate 53. Such a half tone level voltage is set, for example, between +0 to 50 V as the developping bias voltage.

At this state, the photosensitive member 7 is driven to move without performing the exposing operation at the position A. Then, the black developping operation is performed by use of the black developping device 3 (step S13).

Thus, since the exposing operation is not performed and the photosensitive member 7 is charged with a half tone level voltage, a half tone toner image is uniformly formed on the photosensitive member 7. Then, the toner of the half tone toner image is easily scraped off from the photosensitive member 7 by the cleaning device 17 since the toner is attached on the photosensitive member 7 with the half tone level voltage.

At this time, the toner uniformly attached on the photosensitive member 7 serves as abrasive material together with the magnetite included therein with respect to undesirable attached substances on the photosensitive member 7, such as the residual toner, the recording sheet powders, the corona products formed at the electric charger 16, and the ozone degraded layer formed at the transferring charger 21. Thus, such undesirable attached substances, which are difficult to remove by the normal cleaning operation in the copy mode operations, can be removed in this special cleaning mode operation of the present embodiment.

Then, the counter 52 is reset to zero and starts its counting operation again (step S14), and it is judged by the CPU 51 whether the requested copy operation is a multiple copy operation or not (S15). If the multiple copy operation is being requested (YES), the flow branches back to the step S1. If it is not requested or all the requested copy is finished (NO), the copy operation is ended.

In the above mentioned embodiment, the black developping device 3 having a container with the black toner and the abrasive material, is used for the special cleaning mode operation. However, an abrasive material having a practically same color as either yellow, magenta or cyanogen, may be included in the corresponding color toner for the special cleaning mode operation. Alternatively, an exclusive developping device having a container with a special toner and abrasive material just suitable for the special cleaning mode operation, may be employed. If the toner having a relatively high abrasive ability is utilized, the abrasive material is not necessary, and the above mentioned special cleaning mode operation may be performed by the toner without the abrasive material.

Figure 4:
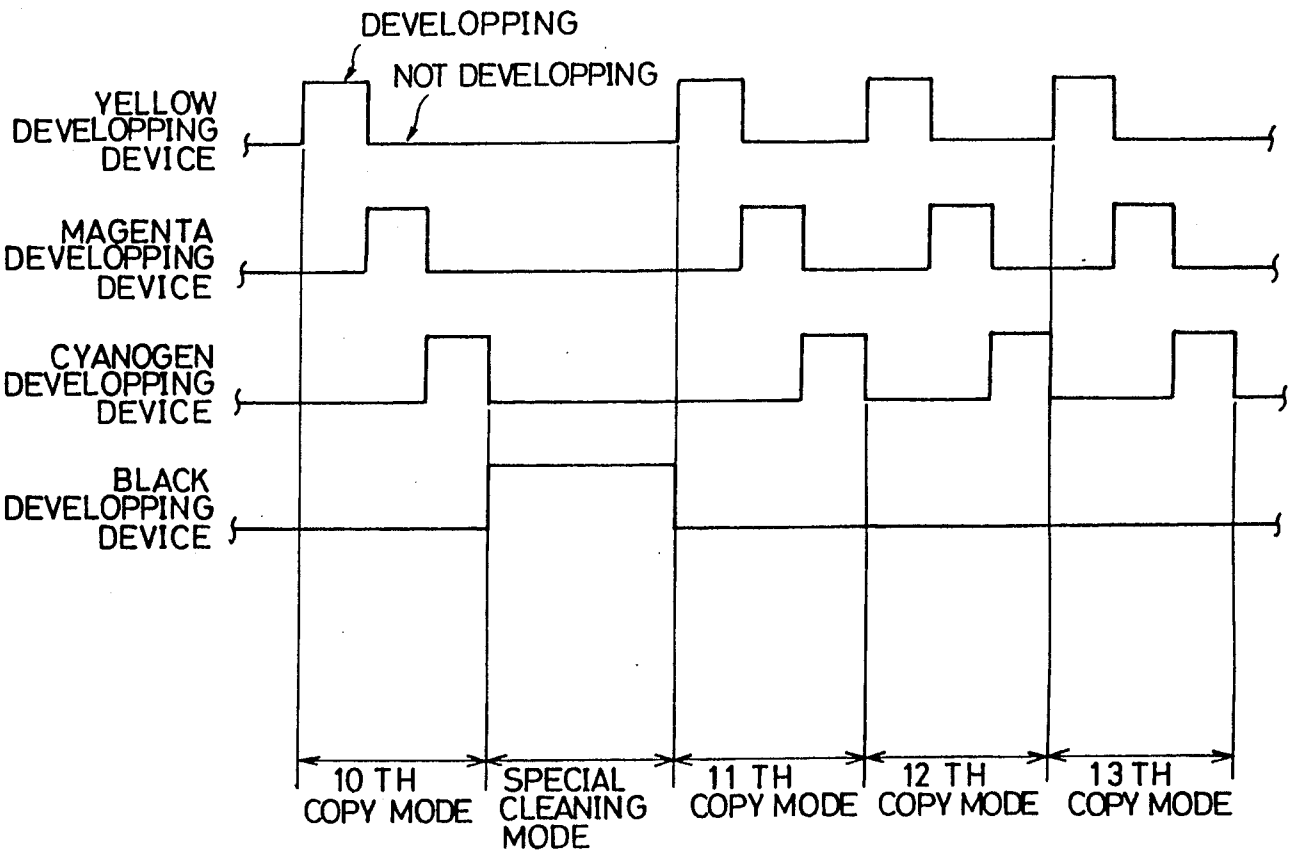
FIG. 4 is a timing chart of the operation of the copying apparatus of FIG. 1.

FIG. 4 shows the timing chart of the operation of the copying apparatus.

In FIG. 4, the timing of each yellow, magenta and cyanogen developping operation corresponding to the above mentioned each of the steps S1 to S3, S4 to S6 and S7 to S9, is indicated. As shown in FIG. 4, after the 10 th copy mode operation according to the count of the counter 52, the black developping operation, corresponding to the above mentioned steps S12 to 14, is executed as the special cleaning mode operation.

Then, the 11 th copy mode operation (step S1 to S10 in FIG. 3) is resumed after the completion of the special cleaning mode operation. If the multiple copy operation of more than 20 times is performed, the special cleaning mode operation is executed once every 10 copy mode operations, for example. It is preferable that this special cleaning mode operation is also performed at the end of one consecutive copy mode operations, so as to wait in a cleaned condition for another consecutive copy mode operations.

The interval of the execution of the special cleaning mode operation is preferably selected with the consideration of the characteristic of each copying apparatus i.e. the type of the toner, the type of the photosensitive member 7, the charging voltage of the photosensitive member 7, condition of the usage and so on. Thus, the special cleaning mode operation may be executed once every less than ten times, 5 times for example, or more than ten times, 20 times for example, in one consecutive copy mode operations. There may be provided in the copying apparatus, means for setting the desirable interval at the user side.

Further, it is also preferable that such an execution of the special cleaning mode operation at the end of one consecutive copy mode operations is performed more than once, depending on the accumulated total number of the copy mode operations. Namely, if the total number of the copy mode operation performed by use of a same photosensitive member 7, is less than 100 times, such a special cleaning mode operation may be performed just once since the photosensitive member 7 is still new, while it may be performed twice or more if the total number exceeds 100 times, so as to cope with the aging degaration of the photosensitive member 7.

In the above described cleaning method, the cleaning blade 17*a* can scrape off the half tone toner image on the photosensitive member 7 with the pressure just as low as in the normal copy mode operation. Thus, such a photosensitive member 7 is used as has a normal or low surface physical strength, such as OPC type, without any trouble of surface damage due to the special cleaning mode operation of the present embodiment.

According to the cleaning method of the present embodiment, the image defect in the copy operation, such as fogging and voiding undesirably introduced in the outputted image, can be effectively avoided by cleaning the photosensitive member 7 with a relatively simple device.

Many widely different embodiments of the present invention may be constructed without departing from the spirit and scope of the present invention. It should be understood that the present invention is not limited to the specific embodiments described in this specification, except as defined in the appended claims.

What is claimed is:

1. A method of cleaning a photosensitive member in an electrophotographic apparatus in which an electrophotographic operation is performed by charging said photosensitive member with a predetermined voltage, exposing said charged photosensitive member so as to form a latent image thereon and developping said latent image by use of toner, comprising the steps of:

charging said photosensitive member with a half tone level voltage which is smaller than said predetermined voltage;

developping said charged photosensitive member by use of toner without exposing said charged photosensitive member, so as to form a uniform half tone toner image thereon; and scraping off said toner of said uniform half tone toner image from said photosensitive member by a blade means abutting thereto.

2. A method according to claim 1, wherein said cleaning method is executed periodically based upon the number of said electrophotographic operations.

3. A method according to claim 1, wherein said photosensitive member is cleaned after every set of electrophotographic operations.

4. A method according to claim 1, wherein said toner used in said developping step includes abrasive material.

5. A method according to claim 1, wherein said electrophotographic apparatus comprises a full color copying apparatus utilizing yellow, magenta, cyanogen and black toners, and said toner used in said developping step comprises said black toner.

6. A method according to claim 1, wherein said photosensitive member comprises OPC.

7. An electrophotographic apparatus, comprising:

a photosensitive member;

means for charging said photosensitive member selectively with a predetermined voltage for an electrophotographic operation and a half tone level voltage which is smaller than said predetermined voltage;

means for exposing said charged photosensitive member, so as to form a latent image thereon;

means for developing said latent image by use of toner, so as to form a toner image thereon;

means for counting the number of times of said electrophotographic operation;

means for cleaning said photosensitive member, including a blade abutting to said photosensitive member for scraping off said toner therefrom; and a control means for directing said charging means to charge with said half tone level voltage periodically based upon the number of said electrophotographic operations according to a count of said counting means, and directing said developing means to develop while stopping said exposing means to expose, so as to form a uniform half tone toner image on said photosensitive member.

8. An electrophotographic apparatus according to claim 7, wherein said control means directs said charging means to charge with said half tone level voltage after every set of electrophotographic operations, and directs said developing means to develop while stopping said exposing means to expose, so as to form said uniform half tone toner image.

9. An electrophotographic apparatus according to claim 7, wherein said toner used for forming said uniform half tone toner image includes abrasive material.

10. An electrophotographic apparatus according to claim 7, wherein said electrophotographic apparatus comprises a full color copying apparatus utilizing yellow, magenta, cyanogen and black toners, and said toner used for forming said uniform half tone toner image comprises said black toner.

11. An electrophotographic apparatus according to claim 7, wherein said photosensitive member comprises OPC.

* * * * *